US005722920A

United States Patent [19]

Bauer

[11] Patent Number: 5,722,920

[45] Date of Patent: Mar. 3, 1998

[54] MARTIAL ARTS PRACTICE APPARATUS

[76] Inventor: Vernon E. Bauer, P.O. Box 29, Arkville, N.Y. 12406

[21] Appl. No.: 677,337

[22] Filed: Jul. 2, 1996

[51] Int. Cl.[6] ..... A63B 69/00; A63B 21/00

[52] U.S. Cl. ..... 482/83; 482/87; 482/90

[58] Field of Search ..... 482/83–90; 473/441–445

[56] References Cited

U.S. PATENT DOCUMENTS

| | | | |
|---|---|---|---|
| D. 334,784 | 4/1993 | DeZulueta . | |
| D. 356,127 | 3/1995 | Mara . | |
| 955,135 | 4/1910 | Chlad | 482/40 |
| 1,733,709 | 10/1929 | Zinnow et al. | 482/83 |
| 2,305,187 | 12/1942 | Neiden . | |
| 4,653,746 | 3/1987 | Brunier . | |
| 4,662,630 | 5/1987 | Dignard et al. . | |
| 4,749,184 | 6/1988 | Tobin . | |
| 5,046,724 | 9/1991 | Sotomayer | 482/83 |
| 5,183,451 | 2/1993 | Hautamaki . | |
| 5,277,679 | 1/1994 | Wells . | |
| 5,342,267 | 8/1994 | Adams et al. . | |
| 5,352,170 | 10/1994 | Condo et al. . | |
| 5,458,552 | 10/1995 | Mara . | |

FOREIGN PATENT DOCUMENTS

| | | | |
|---|---|---|---|
| 1713606 | 2/1992 | U.S.S.R. | 482/83 |

*Primary Examiner*—Jerome Donnelly
*Attorney, Agent, or Firm*—Michael I. Kroll

[57] ABSTRACT

A martial arts practice apparatus (12) comprising a support member (14). A facility (16) is for positioning the support member (14) vertically in a stationary manner. At least one target member (18) is provided. A structure (20) is for suspending the at least one target member (18) outwardly from the support member (14) in a height adjustable manner. An assemblage (22) between the suspending structure (20) and the at least one target member (18) is for returning the at least one target member (18) back to its original position after being struck and kicked by a martial artist (24).

12 Claims, 3 Drawing Sheets

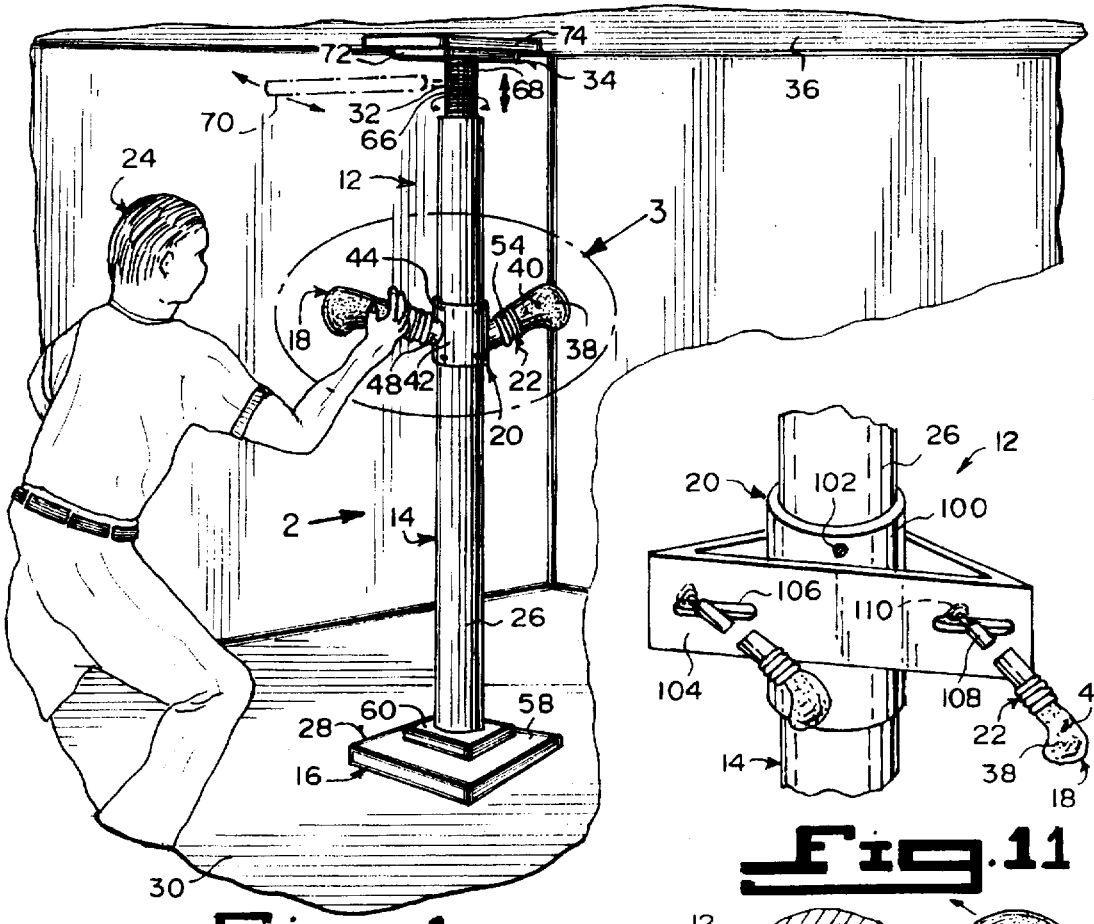
Fig. 1
Fig. 11
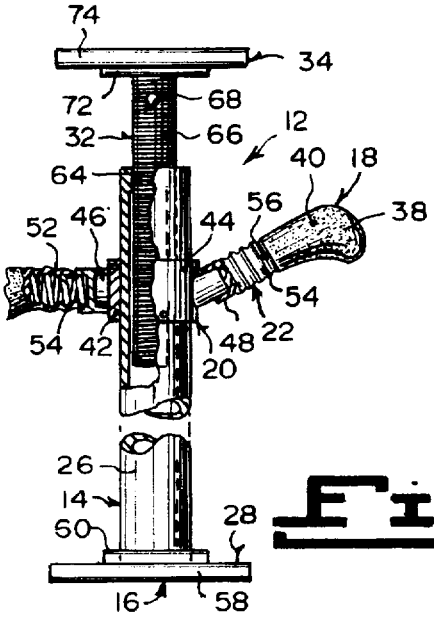
Fig. 2
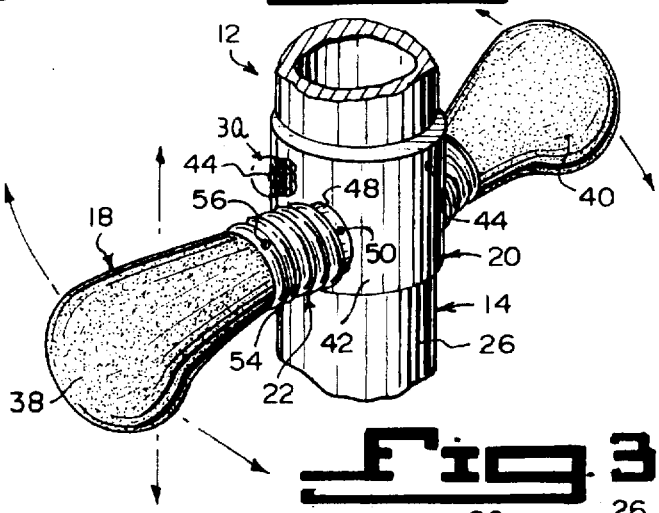
Fig. 3
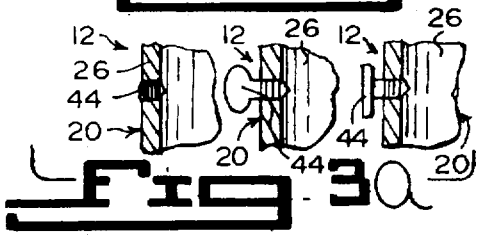
Fig. 3a

MARTIAL ARTS PRACTICE APPARATUS

BACKGROUND OF THE INVENTION

1. Field of the Invention

The instant invention relates generally to sport training devices and more specifically it relates to a martial arts practice apparatus.

2. Description of the Prior Art

Numerous sport training devices have been provided in prior art. For example, U.S. Pat. No. 2,305,187 to Neiden; U.S. Pat. No. 4,653,746 to Brunier; U.S. Pat. No. 4,662,630 to Dignard et al.; U.S. Pat. No. 4,749,184 to Tobin; U.S. Pat. No. 5,183,451 to Hautamaki; U.S. Pat. No. 5,277,679 to Wells; U.S. Pat. No. 5,342,267 to Adams et al.; U.S. Pat. No. 5,352,170 to Condo et al.; U.S. Pat. No. 5,458,552 to Mara; Des. 334,784 to DeZuluetta and Des. 356,127 to Mara all are illustrative of such prior art. While these units may be suitable for the particular purpose to which they address, they would not be as suitable for the purposes of the present invention as heretofore described.

NEIDEN, BENJAMIN H.

SPORT PRACTICE APPARATUS

U.S. Pat. No. 2,305,187

An apparatus for practising tennis comprising a support, a second support, means to detachably secure the second support to the first support in a selected vertical position on the first support, a ball, and means to suspend the ball from the second support.

BRUNIER, MICHEL

SPORT APPARATUS FOR TRAINING IN BOXING AND IN THE MARTIAL ARTS

U.S. Pat. No. 4,653,746

Sport apparatus for training in boxing and in the martial arts and similar exercises, comprising an elongate stuffed target suspended from a support by means of a link, the link being dismountable, of adjustable length, and connected to the lower end of a spring member whose upper end is connected to the support.

DIGNARD, MICHAEL J.

ROBERTS, PAUL C.

MARTIAL ARTS STRIKING APPARATUS

U.S. Pat. No. 4,662,630

Martial arts striking apparatus including a striking board and mounting apparatus for mounting the striking board at different vertical heights and at different angles with respect to the vertical and for mounting the striking board resiliently whereby the board will pivot in response to a received blow and will thereafter be returned to its initial position.

TOBIN, EDWARD D.

SELF-RESTORING KICKING PRACTICE APPARATUS

U.S. Pat. No. 4,749,184

A kicking practice apparatus including a freestanding support frame having spaced apart upstanding members mounted at their lower ends to a floor supported primary base and rigidly connected at their upper ends by a reinforcing structure. The upstanding members are disposed in a generally triangular arrangement. An impact-receiving member has a pivot sleeve mounting the member to a front one of the support frame members such that the impact-receiving member extends in cantilever fashion generally outwardly from the front member and away from a rear pair of the support frame members. The impact-receiving member is pivotable relative to the front member in transverse relation thereto and in either clockwise or counterclockwise direction thereabout. Sets of resiliently yieldable springs and elastic cords extend in opposing relation to one another past and in contact with the pivot sleeve and interconnect the impact-receiving member with the rear pair of members. The springs and cords impose a restoring force on the impact-receiving member and a dampening force on the pivot sleeve for maintaining the impact-receiving member at an initial rest position and returning the impact-receiving member to the rest position with occurrence of only negligible oscillation after pivoting of the impact-receiving member in either direction in response to an impact being applied to the member. Also, the support frame can include a secondary base and bracing members interconnecting the primary base and reinforcing structure with the secondary base to support the upstanding members in inclined positions.

HAUTAMAKI, JEFFREY L.

MARTIAL ARTS PRACTICE DEVICE

U.S. Pat. No. 5,183,451

A martial arts practice device essentially comprises an I-beam having a plurality of striking pads selectively positionable along its vertical height. The pads are cylindrically shaped and are attached to the I-beam by resilient springs so that they can flexibly move when struck by a user. A plurality of the devices may be interconnected so as to encircle a user to thus give the user the opportunity to strike in many different directions while improving his martial arts skills. Velcro attached padding may be positioned around the I-beam to prevent user injury and various types of abrasive surface covers may be positioned over the pads to toughen a user's hands and feet.

WELLS, RAY L.

MARTIAL ARTS PRACTICE APPARATUS WITH AUTOMATIC RETURN

U.S. Pat. No. 5,277,679

Karate practice apparatus includes a target pad mounted on a horizontally extending arm. The arm is adjustably mounted on a vertical shaft which is anchored at its lower end in a base housing. A resistance system in the base housing yieldingly resists rotation of the shaft when the target is struck from either side either by kicking or punching, so as to return the target pad to its neutral position. The target pad is composed of a high density foam material which is molded around the support arm and is readily interchangeable, so as to conform to the level of skill of the athlete.

ADAMS, RONALD L.

BLOMQUIST, JAMES E.

STRIKING DEVICE

U.S. Pat. No. 5,342,267

An improved striking device is provided as including a main post having two main longitudinal slots. An insert post having an outside diameter that is less than the inside diameter of the main post is provided. A striking surface is provided that is attached to an arm which in turn is attached to an arm housing. The arm housing has a first housing end and a second housing end. The arm housing is placed around the main post and the second housing end rests upon a support axle passing through the insert post. The first housing end includes a cam surface having two peaks located on opposite sides thereof and two valleys located on opposite sides thereof with each of the two valleys disposed between each of the two peaks. A cam follower is included which is retained in contact against the cam surface by a pair of springs. During rotation of the arm housing the cam follower cooperates with the cam surface of the arm housing to provide a first striking position and a second striking position that are each locate done hundred and eighty degrees of rotation apart with respect to each other. As the arm housing rotates the cam surface extends the cam follower which in turn extends the pair of springs in proportion to the contour of the cam surface. If sufficient force is imparted to the striking surface, the arm housing is urged away from the first striking position, and indexes into the second striking position.

CONDO, GIROLAMAO

TROCOLA, LUIGI

BOXING TRAINING APPARATUS

U.S. Pat. No. 5,352,170

A boxing training apparatus for developing aiming and blocking punching techniques includes a punching pad or ball, which is attached to a free end of an arm supported on a substantially vertical column. Elements provide for adjustment of the arm height, projection and inclination relative to the supporting column.

MARA, SCOTT G.

MARTIAL ARTS FOCUS TARGET APPARATUS

U.S. Pat. No. 5,458,552

A martial arts focus target apparatus for the practice of martial arts techniques and procedures. The apparatus includes a base, a post extending upright from the base and one or more flexible focus target pads having a free extended one end and releasably secured at the other end by a locking member to the post at selected heights, sides and angles.

DeZULUETTA, JULIAN

MARTIAL ARTS KICKING BAG

U.S. Pat. No. Des. 334,784

The ornamental design for a martial arts kicking bag, as shown and described.

FIG. 1 is a top and side perspective view of a martial arts kicking bag, showing the new design:

FIG. 2 is a side elevational view thereof;

FIG. 3 is a side elevational view thereof;

MARA, SCOTT G.

MARTIAL ARTS PRACTICE STAND

U.S. Pat. No. Des. 356,127

The ornamental design for martial arts practice stand, as shown and described.

Figure 4:
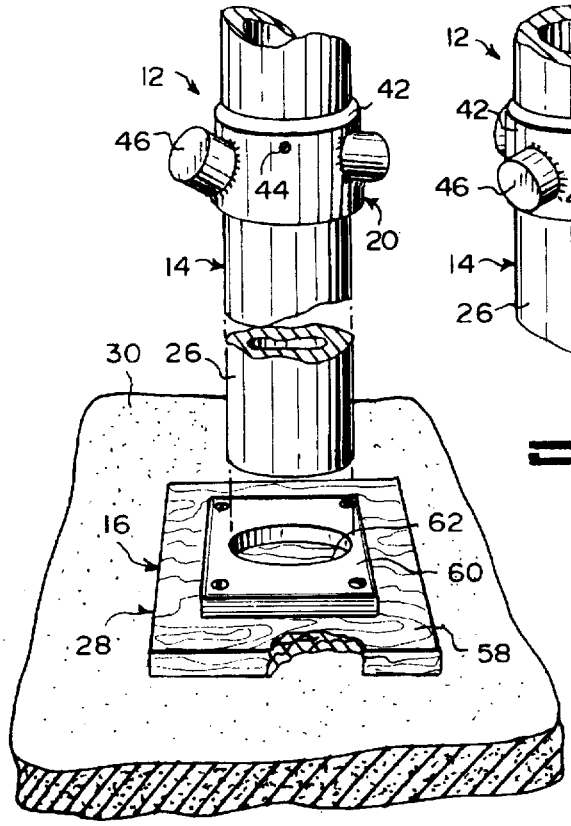
FIG. 4 is a front elevational view thereof.

FIG. 1 is a top perspective view from above the martial arts practice stand of the design;

FIG. 2 is a front elevational view of the design of FIG. 1, with the back elevational view being the same;

FIG. 3 is a side elevational view of the design of FIG. 1, with the other side being the same; and FIG. 4 is a top plan view of the design of FIG. 1, with the bottom not being ornamented.

SUMMARY OF THE INVENTION

A primary object of the present invention is to provide a martial arts practice apparatus that will overcome the shortcomings of the prior art devices.

Another object is to provide a martial arts practice apparatus that will allow a martial artist to develop a kicking and striking technique at a focus pad target without the aid of another martial artist, since the focus pad target will return back to its original position.

An additional object is to provide a martial arts practice apparatus that can be easily disassembled for storage or then reassembled in another area for use by the martial artist.

A further object is to provide a martial arts practice apparatus that is simple and easy to use.

A still further object is to provide a martial arts practice apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view showing a martial artist using a first embodiment of the instant invention in a room.

FIG. 2 is an elevational view of the first embodiment per se taken in the direction of arrow 2 in FIG. 1, with parts broken away and in section.

FIG. 3 is an enlarged perspective view of the area indicated by arrow 3 in FIG. 1.

FIG. 3*a* are enlarged cross sectional views as indicated by arrow 3*a* in FIG. 3, showing different types of setscrews.

FIG. 4 is a partly exploded perspective view of a portion of the first embodiment with parts broken away and in section.

Figure 5:
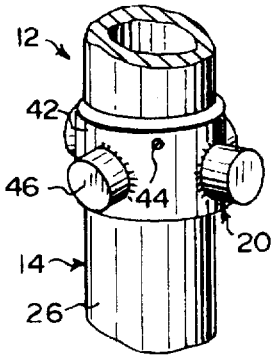
FIG. 5 is a rear elevational view thereof.

FIG. 5 is a perspective view of a portion of the first embodiment, showing a second stud configuration on the height adjustable collar.

Figure 6:
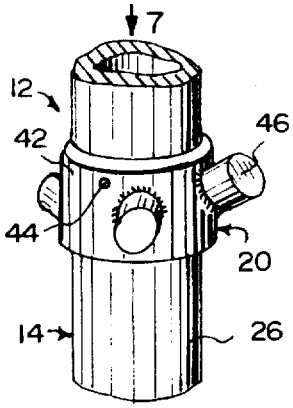
FIG. 6 is a top plan view thereof, the bottom being unadorned.

FIG. 6 is a perspective view similar to FIG. 5, showing a third stud configuration on the height adjustable collar.

Figure 7:
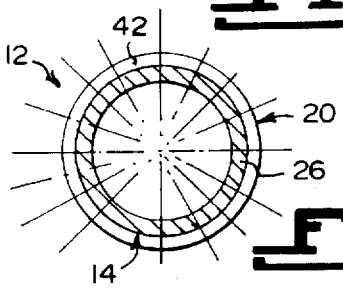

FIG. 7 is a diagrammatic top view taken in the direction of arrow 7 in FIG. 6, showing various radial positions for the studs on the height adjustable collar.

Figure 8:
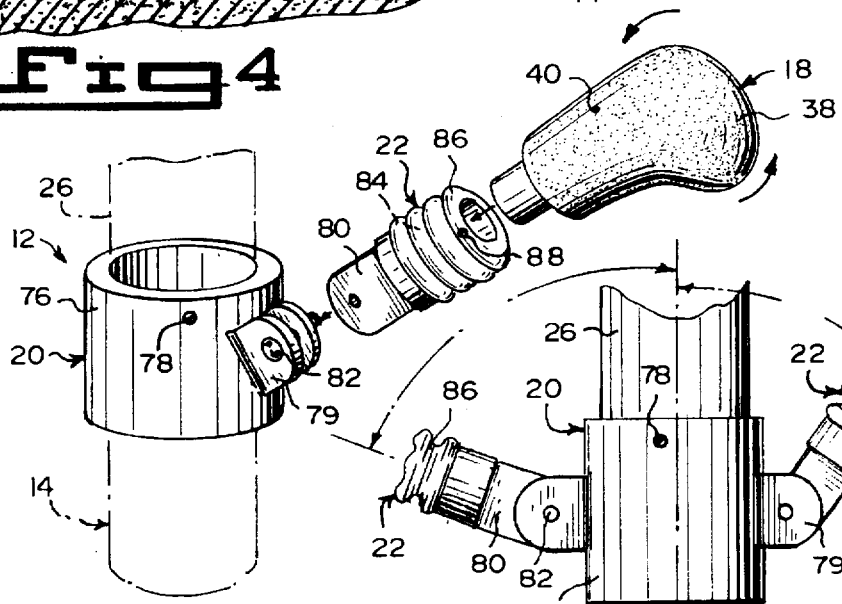

FIG. 8 is an exploded perspective view showing a pivotable target member on the height adjustable collar.

Figure 9:
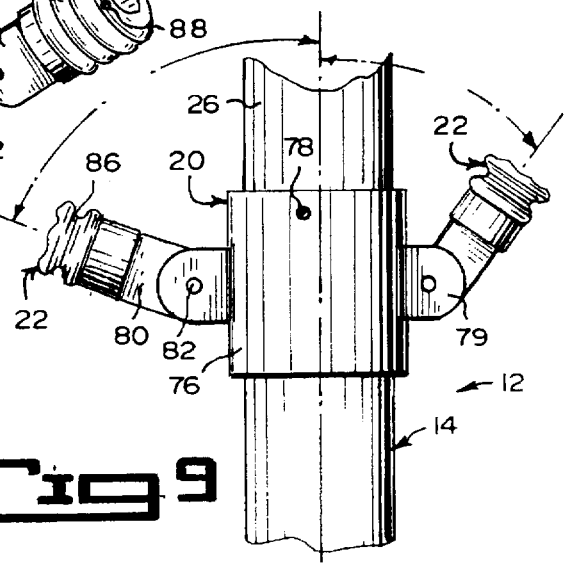

FIG. 9 is an elevational view with parts broken away, showing two pivotable target members on the height adjustable collar.

Figure 10:
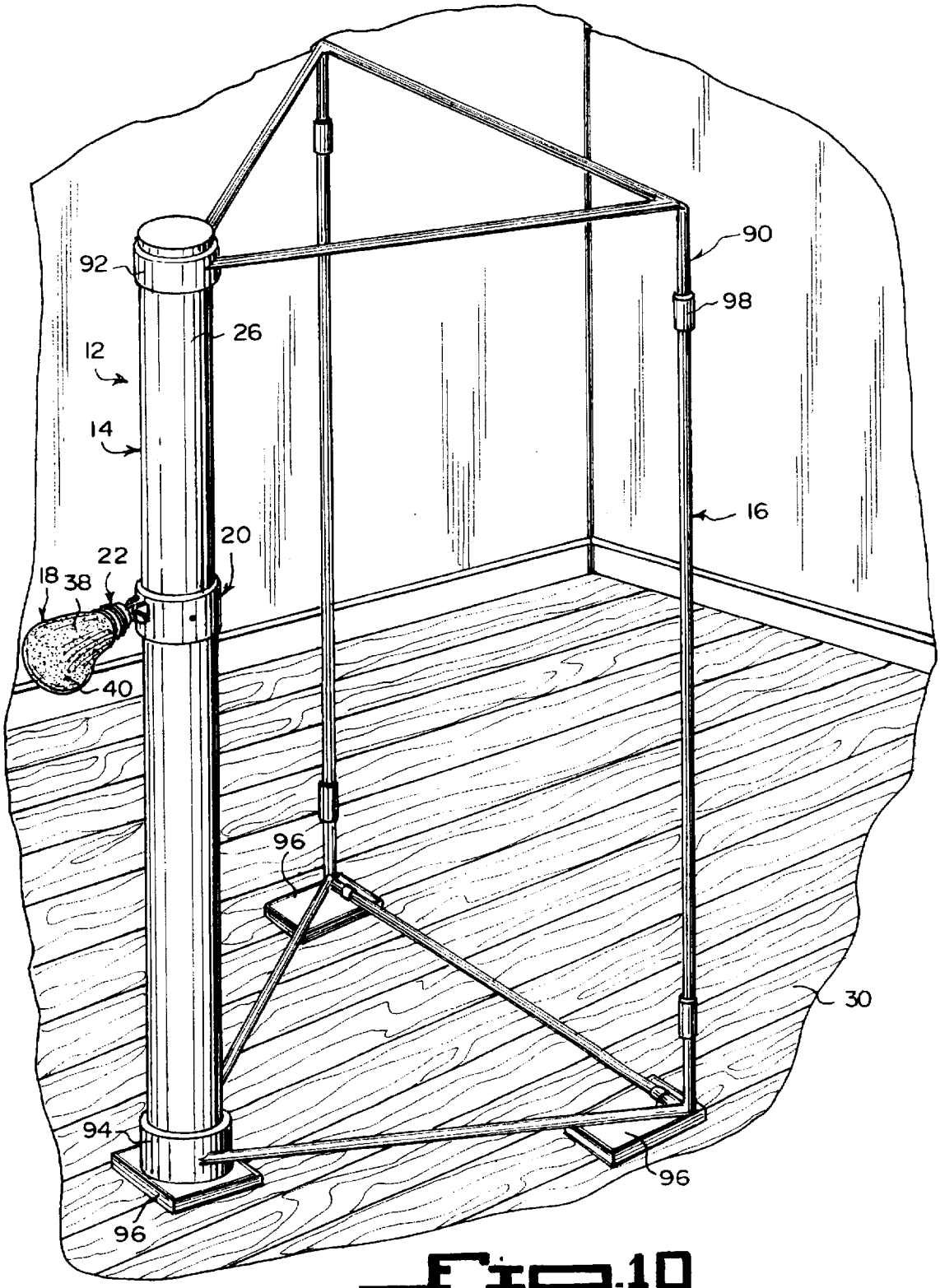

FIG. 10 is a perspective view, showing a second embodiment of the instant invention in a room.

FIG. 11 is a perspective view with parts broken away, showing a special collar with two horizontal adjustable target members used to train hook and speed round house kicks.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 11 illustrates a martial arts practice apparatus 12 comprising a support member 14. A facility 16 is for positioning the support member 14 vertically in a stationary manner. At least one target member 18 is provided. A structure 20 is for suspending the at least one target member 18 outwardly from the support member 14 in a height adjustable manner. An assemblage 22 between the suspending structure 20 and the at least one target member 18 is for returning the at least one target member 18 back t its original position after being struck and kicked by a martial artist 24.

The support member 14 is an elongated cylindrical column 26. The positioning facility 16, as shown in FIGS. 1, 2 and 4, includes a base assembly 28 on a bottom end of support member 14, wherein the base assembly 28 sits upon a floor 30. A height adjustment unit 32 is on a top end of the support member 14. A head assembly 34 is on the height adjustment unit 32. The head assembly 34 will butt against a ceiling 36 by manipulation of the height adjustment unit 32.

The at least one target member 18 is a focus pad 38 made out of a strong soft padded material 40. The suspending structure 20, as shown in FIGS. 1 through 6, consists of a collar 42 which fits upon the support member 14 in a sliding manner. A setscrew 44 in the collar 42 is to hold the collar 42 in a fixed position upon the support member 14. At least one stud 46 extends outwardly from the collar 42 to engage with the returning assemblage 22.

The returning assemblage 22 comprises a sleeve 48 to fit over the stud 46. A setscrew 50 in the sleeve 48 holds the sleeve 48 in a fixed position on the stud 46. A coil spring 52 is provided. A flexible cylindrical accordion cover 54 is over the coil spring 52 and is connected at a first end to the sleeve 48. A set screw 56 in a second end of the flexible cover 54 holds an end of the focus pad 38 in a fixed position in the second end of the flexible cover 54.

The base assembly 28 includes a floor plate 58 and a column plate 60 fixed onto the floor plate 58. The column plate 60 has an aperture 62 to receive the bottom end of the support member 14.

The height adjustment unit 32 consists of the support member 14 having an internally threaded bore 64 in the top end. A threaded shank 66 engages with the internally threaded bore 64. The threaded shank 66 has a transverse hole 68 therethrough near a top end. A turn handle rod 70, as shown in phantom in FIG. 1, fits into the transverse hole 68, so as to rotate the threaded shank 66 in the internally threaded bore 64. The head assembly 34 includes a shank plate 72 and a ceiling plate 74 fixed onto the shank plate 72.

The suspending structure 20, as shown in FIGS. 8 and 9, consists of a collar 76 which fits upon the support member 14 in a sliding manner. A setscrew 78 is in the collar 76 to hold the collar 76 in a fixed position upon the support member 14. At least one fork end 79 extends outwardly from the collar 76, to engage with the returning assemblage 22.

The returning assemblage 22 in FIGS. 8 and 9, comprises a lug 80 to fit into the fork end 79. A fastener 82 holds the lug 80 in the fork end 79. A coil spring 84 is provided. A flexible cylindrical accordion cover 86 is over the coil spring 84 and is connected at a first end to the lug 80. A setscrew 88 is in a second end of the flexible cover 86, to hold an end of the focus pad 38 in a fixed position in the second end of the flexible cover 86.

The positioning facility 16 in FIG. 10, includes a triangular shaped pipe frame 90, having top and bottom guide collars 92, 94 connected to the support member 14. Three base plates 96 are provided. Each base plate 96 is located at one bottom corner of the triangular shaped pipe frame 90 and a bottom end of the support member 14. The base plates 96 sit upon the floor 30. A plurality of connectors 98 are in the triangular shaped frame 90, so that the triangular shaped frame 90 can be quickly assembled and disassembled.

In FIG. 11, the suspending structure 20 consists of a collar 100 which fits upon the support member 14 in a sliding manner. A setscrew 102 is in the collar 100 to hold the collar 100 in a fixed position upon the support member 14. A triangular frame plate member 104 is connected to and about the collar 100. The triangular frame plate member 104 has at least one horizontal slot 106. At least one stud 108 engages with the returning assemblage 22. At least one bolt 110 extends through the at least one horizontal slot 106 and into a back end of the at least one stud 108, to retain the at least one stud 108 in an adjusted manner to the triangular frame plate member 104, so as to be used to train for hook and speed round house kicks.

LIST OF REFERENCE NUMBERS 12 martial arts practice apparatus
14 support member of 12
16 positioning facility of 12
18 target member of 12
20 suspending structure of 12
22 returning assemblage of 12
24 martial artist
26 elongated cylindrical column for 14
28 base assembly of 16
30 floor
32 height adjustment unit of 16
34 head assembly of 16 on 32
36 ceiling
38 focus pad for 18
40 strong soft padded material of 38
42 collar of 20 on 14
44 setscrew of 20 in 42
46 stud of 20 on 42

48 sleeve of 22 on 46
50 setscrew of 22 in 48
52 coil spring of 22
54 flexible cylindrical accordion cover of 22
56 setscrew of 22 in 54
58 floor plate of 28
60 column plate of 28 on 58
62 aperture in 60
64 internally threaded bore in 14 of 32
66 threaded shank of 32
68 transverse hole in 66
70 turn handle rod of 32
72 shank plate of 34
74 ceiling plate of 34
76 collar of 20 on 14
78 setscrew of 20 in 76
80 lug of 22
82 fastener of 22
84 coil spring of 22
86 flexible cylindrical accordion cover of 22
88 setscrew of 22 in 86
90 triangular shaped pipe frame of 16
92 top guide collar of 16
94 bottom guide collar of 16
96 base plate of 16
98 connector of 16
100 collar of 20
102 setscrew of 20 in 100
104 triangular frame plate member of 20 on 100
106 horizontal slot in 104
108 stud of 20
110 bolt of 20

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A martial arts practice apparatus comprising:

a) a support member;

b) means for positioning said support member vertically in a stationary manner;

c) at least one target member;

d) means for suspending said at least one target member outwardly from said support member in a height adjustable manner;

e) means between said suspending means and said at least one target member for returning said at least one target member back to its original position after being struck by a martial artist;

f) said suspending means including:

i) a collar which fits upon said support member in a sliding manner;

ii) a setscrew in said collar to hold said collar in a fixed position upon said support member; and iii) at least one stud extending outwardly from said collar to engage with said returning means; and g) said returning means including:

i) a sleeve to fit over said stud;

ii) a setscrew in said sleeve to hold said sleeve in a fixed position on said stud;

iii) a coil spring;

iv) a flexible cylindrical accordion cover over said coil spring and connected at a first end to said sleeve; and v) a setscrew in a second end of said flexible cover to hold an end of said focus pad in a fixed position in said second end of said flexible cover.

2. A martial arts practice apparatus as recited in claim 1, wherein said support member is an elongated cylindrical column.

3. A martial arts practice apparatus as recited in claim 1, wherein said positioning means includes:

a) a base assembly on a bottom end of said support member, wherein said base assembly sits upon a floor;

b) a height adjustment unit on a top end of said support member; and c) a head assembly on said height adjustment unit, wherein said head assembly will butt against a ceiling by manipulation of said height adjustment unit.

4. A martial arts practice apparatus as recited in claim 1, wherein said at least one target member is a focus pad made out of a strong soft padded material.

5. A martial arts practice apparatus as recited in claim 3, wherein said base assembly includes:

a) a floor plate; and b) a column plate fixed onto said floor plate, said column plate having an aperture to receive the bottom end of said support member.

6. A martial arts practice apparatus as recited in claim 3, wherein said height adjustment unit includes:

a) said support member having an internally threaded bore in the top end;

b) a threaded shank to engage with said internally threaded bore, said threaded shank having a transverse hole therethrough near a top end; and c) a turn handle rod to fit into said transverse hole, so as to rotate said threaded shank in said internally threaded bore.

7. A martial arts practice apparatus as recited in claim 3, wherein said head assembly includes:

a) a shank plate; and b) a ceiling plate fixed onto said shank plate.

8. A martial arts practice apparatus as recited in claim 2, wherein said positioning means includes:

a) a base assembly on a bottom end of said support member, wherein said base assembly sits upon a floor;

b) a height adjustment unit on a top end of said support member; and c) a head assembly on said height adjustment unit, wherein said head assembly will butt against a ceiling by manipulation of said height adjustment unit.

9. A martial arts practice apparatus as recited in claim 8, wherein said at least one target member is a focus pad made out of a strong soft padded material.

10. A martial arts practice apparatus as recited in claim 9, wherein said base assembly includes:

a) a floor plate; and b) a column plate fixed onto said floor plate, said column plate having an aperture to receive the bottom end of said support member.

11. A martial arts practice apparatus as recited in claim 10, wherein said height adjustment unit includes:

a) said support member having an internally threaded bore in the top end;

b) a threaded shank to engage with said internally threaded bore, said threaded shank having a transverse hole therethrough near a top end; and c) a turn handle rod to fit into said transverse hole, so as to rotate said threaded shank in said internally threaded bore.

12. A martial arts practice apparatus as recited in claim 11, wherein said head assembly includes:

a) a shank plate; and b) a ceiling plate fixed onto said shank plate.

* * * * *